US005813332A

United States Patent [19]

Reichel-Langer et al.

[11] Patent Number: 5,813,332

[45] Date of Patent: Sep. 29, 1998

[54] DEVICE FOR REMOISTENING A WEB OF PRINTED MATERIAL

[75] Inventors: Karl-Heinz Reichel-Langer, Wemding; Werner Kettl, Neusäss; Peter Schüller, Mering, all of Germany

[73] Assignee: Grafotec GmbH, Diedorf, Germany

[21] Appl. No.: 842,886

[22] Filed: Apr. 17, 1997

[30] Foreign Application Priority Data

Apr. 17, 1996 [DE] Germany ..... 196 15 198.8

[51] Int. Cl.[6] ..... B41L 23/00

[52] U.S. Cl. ..... 101/147; 101/132.5

[58] Field of Search ..... 101/147, 132.5, 101/130, 487, 488, 424.1, 424.2

[56] References Cited

U.S. PATENT DOCUMENTS

| | | | |
|---|---|---|---|
| 2,299,026 | 10/1942 | Merrill | 101/147 |
| 4,852,492 | 8/1989 | Pfizenmaier | 101/424.1 |
| 5,040,457 | 8/1991 | Lin | 101/147 |
| 5,184,555 | 2/1993 | Quadracci et al. | 101/424.1 |
| 5,217,065 | 6/1993 | Green et al. | 165/117 |
| 5,303,652 | 4/1994 | Gasparrini et al. | 101/147 |

*Primary Examiner*—Edgar S. Burr
*Assistant Examiner*—Anthony H. Nguyen
*Attorney, Agent, or Firm*—Jones, Tullar & Cooper, P.C.

[57] ABSTRACT

In a remoistening device for remoistening a freshly printed and dried web of printed material has a housing through which the web of printed material runs. The remoistening device is a disposed downstream from a dryer, preferably in the area between the dryer and a cooling device. The remoistening device is provided with an inlet and outlet slot, in which spray nozzles, which are arranged above and underneath the conveyance plane of the web of printed material and which can be supplied with a moistening agent, are provided. It is possible to achieve a high degree of freedom from trouble and soiling is achieved in that drip catchers are arranged at the lower edges of the walls of the upper housing area of the remoistening device which cross an conveyance plane of the web of printed material. The liquid resulting in the drip catchers and in the lower housing area of the remoistening device can be removed, and that air squeegee devices, which can be charged with compressed air and are situated across from each other with respect to the conveyance plane of the web of printed material, are provided at least in the area of the outlet slot.

15 Claims, 2 Drawing Sheets

DEVICE FOR REMOISTENING A WEB OF PRINTED MATERIAL

FIELD OF THE INVENTION

The present invention relates to a remoistening device for remoistening a freshly printed and dried web of printed material, having a housing through which the web of printed material runs. The remoistening device disposed downstream from a dryer, preferably in the area between the dryer and a cooling device. The remoistening device has an inlet and outlet slot, in which spray nozzles, which are arranged above and underneath the conveyance plane of the web of printed material and which can be supplied with a moistening agent, are provided.

BACKGROUND OF THE INVENTION

A device of this type, which is disposed between the dryer and the cooling device, is known from German Patent Publication DE 44 05 332 A1. In this known device the housing walls crossing the web of printed material in the area of the inlet and outlet slots terminate openly at their lower ends. Therefore there is the danger that the liquid, which reaches the walls in the form of liquid spatter or fog and/or the liquid condensing on the walls, drips from the lower edges of the walls of the upper housing area crossing the web of printed material and gets on the web of printed material. Such drops can result in markings on the web of printed material if it moves. In the case of stopping the web the liquid drops dripping on the web of printed material made of paper can lead to softening of the paper, so that there is an increased danger of breaking upon a restart. A further disadvantage of the known device is to be seen in that moisture in the form of liquid spatter and/or fog and/or steam can reach the exterior through the web outlet slot. Although this danger can be lessened by reducing the clear width of the slot, it cannot be removed. In this connection it must be assumed that the slot width cannot be too small, because the web of printed material, which can be excited to flutter by the application of moisture, is not permitted to come into contact with the slot edges in order to prevent damage. It is therefore possible for undesired moisture disposition in the vicinity and in particular on the rollers of the downstream cooling device, which can affect cooling negatively. The known device therefore proves to be insufficiently reliable and safe.

SUMMARY OF THE INVENTION

Based on the foregoing, it is therefore the object of an present invention to improve a device in accordance with the species noted above in such a way, that a high degree of freedom from trouble and soiling is achieved by simple and cost-effective means.

This object is attained in accordance with the present invention in that drip catchers are arranged at the lower edges of the walls of the upper housing area which cross the conveyance plane of the web of printed material, that the liquid resulting in the drip catchers and in the lower housing area can be removed and that air squeegee devices, which can be charged with compressed air and are situated across from each other with respect to the conveyance plane of the web of printed material, are provided at least in the area of the outlet slot.

The drip catchers at the underside of the transverse walls of the upper housing area and the draining of the resulting liquid assure that the web of printed material is only charged with liquid vaporized by means of the spray nozzles and not with increased collections of liquid, so that the web of printed material is only remoistened, but not soiled or softened, which increases operational dependability and improves the result of the work. These advantages are further aided by the air squeegee devices associated with the outlet slot.

In an advantageous manner these operate contactless and allow a large clear width of the outlet slot, so that damage of the web does not take place, even if it is strongly deflected out of the imagined conveyance plane. But moisture in the form of liquid spatter, fog or steam is still dependably prevented from being carried along toward the exterior by the web of printed material moving at high speed. Thus, charging with moisture of the surroundings and of possibly downstream arranged cooling rollers is effectively prevented.

Advantageous embodiments and useful further developments of the superordinated steps are further disclosed.

The drip catchers can suitably be designed as tubes, closed at least toward the bottom and provided at least with an upper row of holes, which are respectively covered by a hose of a textile material, preferably velvet. These steps result in particularly great dependability. The captured liquid is taken to the holes of the tubes by capillary action and enters them in this way. In this connection the employment of velvet results in particularly good absorbency.

The tubes acting as drip catchers can advantageously be charged with an induced suction draft. The suction effect of the textile hose is aided by this and dependable draining of the captured liquid is assured.

A further advantageous measure can consist in that the housing has two parts which can be lifted off each other and are embodied as the upper part and the lower part, which are sealed against each other in the area of the housing front faces when placed against each other. In this case it is possible to simply lift the upper part off the lower part to make the insertion of the web easier. This can be arranged stationary in an advantageous manner. It is still assured that no liquid can exit at the housing front faces extending parallel with respect to the direction of running of the web. Since the width of the housing is greater than the width of the web, the liquid deposited on the front faces can pass from the top to the bottom without interfering with the web.

A further advantageous step, which is particularly preferred when the remoistening device is arranged between the dryer and the cooling device, can consist in that the housing has respectively one spray chamber at the top and bottom, which contain the spray nozzles, as well as a condensation chamber without nozzles arranged downstream of it in the direction of running of the web of printed material. Surplus liquid, which was not absorbed by the web of printed material, can evaporate from the hot printed web in the nozzle-free evaporation chamber. This steam can be deposited on the walls of the condensation chamber without any interference with this condensation by liquid sprayed in by the spray nozzles taking place. It is assured by this that the surroundings remain dry. Because of this step it is also possible in an advantageous manner to provide dependable pressure equalization with the aid of exhaust air chimneys connected to the condensation chambers and to prevent overpressure in the interior of the housing.

In a practical manner the housing of the remoistening device can be received on the support of the cooling device by means of a support device. A separate support is prevented by this.

In a further development of the superordinated steps, the spray nozzles can be embodied as two-component nozzles which can be charged with liquid and air. It is assured here that comparatively small water droplets are formed which, however, are charged with comparatively high energy. But the droplets have a great penetration force and therefore can easily penetrate the layer of air adjoining the top and bottom of the web of printed material and assuredly get on the web of printed material, so that the latter is provided with even remoistening.

Further advantageous embodiments and useful further developments of the superordinated steps are discussed and can be inferred from the description of examples provided below by means of the drawings.

DETAILED DESCRIPTION OF THE PREFERRED EMBODIMENT

Figure 1:
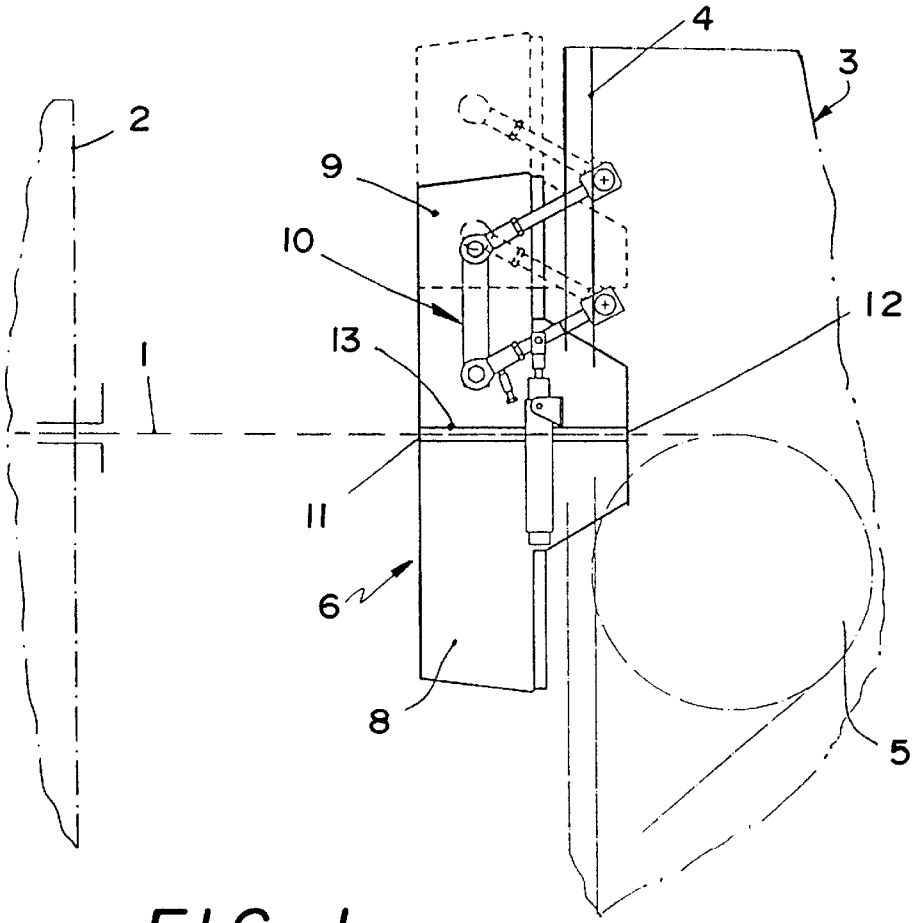
FIG. 1 is a lateral view of a remoistening device in accordance with the invention disposed between the dryer and the cooling device of a rotary printing press.

In a web-fed rotary printing press, for example a web-fed rotary offset printing press, the web of printed material 1 runs through a dryer 2 downstream of the last printing unit, as indicated in FIG. 1, in which the fresh print is dried by the application of heat, and then moves through a cooling device 3, in which the web of printed material 1 heated in the dryer is cooled. As a rule, the cooling device consists of cooling rollers 5 disposed in a cooling roller support 4. To compensate for the moisture removed from the web of printed material in the dryer 2, the web is subjected to remoistening.

Figure 2:
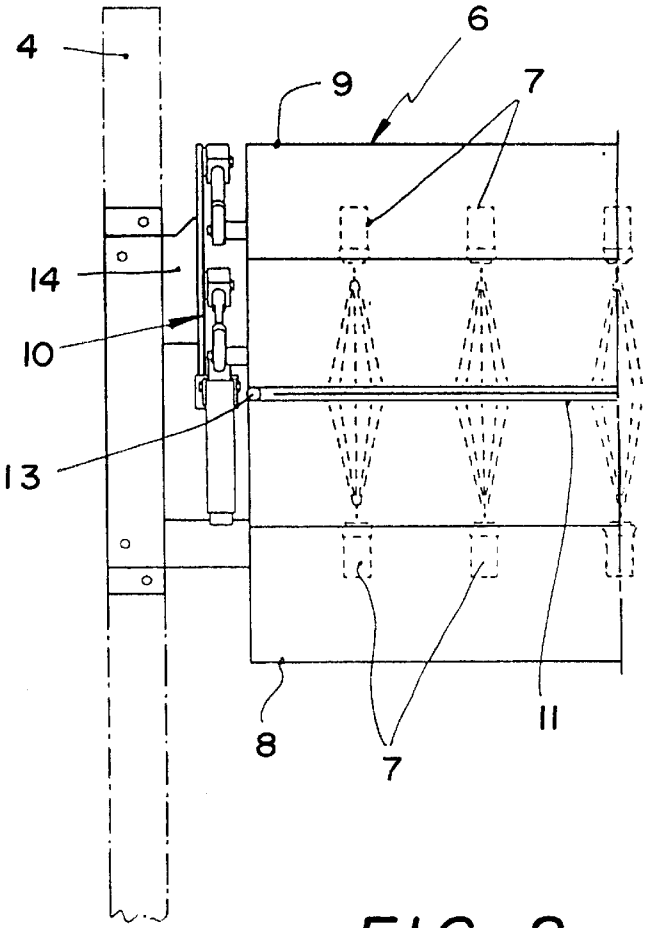
FIG. 2 is a frontal view of the remoistening device in accordance with the present invention in FIG. 1.

A remoistening device 6, in FIG. 1 arranged between the dryer 2 and the cooling device 3, through which the web of printed material 1 runs, is provided for this. As can be seen from FIG. 2, it is provided with spray nozzles 7 arranged above and below the web of printed material 1 for charging the web of printed material with remoistening liquid. The spray nozzles 7 are situated in a housing, having a lower housing part 8 disposed below the conveyance plane of the web of printed material 1, and an upper housing part 9, which can be placed on it and is disposed above the conveyance plane of the web of printed material 1.

The upper housing part 9 can be raised and lowered by means of a lifting device 10. A simple and easy insertion of the web of printed material 1 is possible in the raised position of the upper housing part 9, indicated by broken lines in FIG. 1. The two housing parts are embodied in such a way that an inlet slot 11 associated with the web of printed material 1 results at the inlet side, and an outlet slot 12 associated with the web of printed material 1 at the outlet side. In the position where they are placed on top of each other, the two housing parts are sealed against each other by means of a suitable sealing strip 13 at the transversely, i.e. in the running direction of the web, extending front faces.

In the example represented, the lifting device 10 for raising the upper housing part 9 consists of two pivot levers arranged in the shape of a parallelogram, which can be actuated by means of a lifting cylinder. As can best be seen in FIG. 2, the pivot levers and the lifting cylinder are received on a holding device configured as lateral brackets 14, by means of which the stationary lower housing part 8 is fastened on the support 4 of the cooling device 3. However, it would be just as easily conceivable to assign the remoistening device 6 its own machine support.

Figures 3, 4:
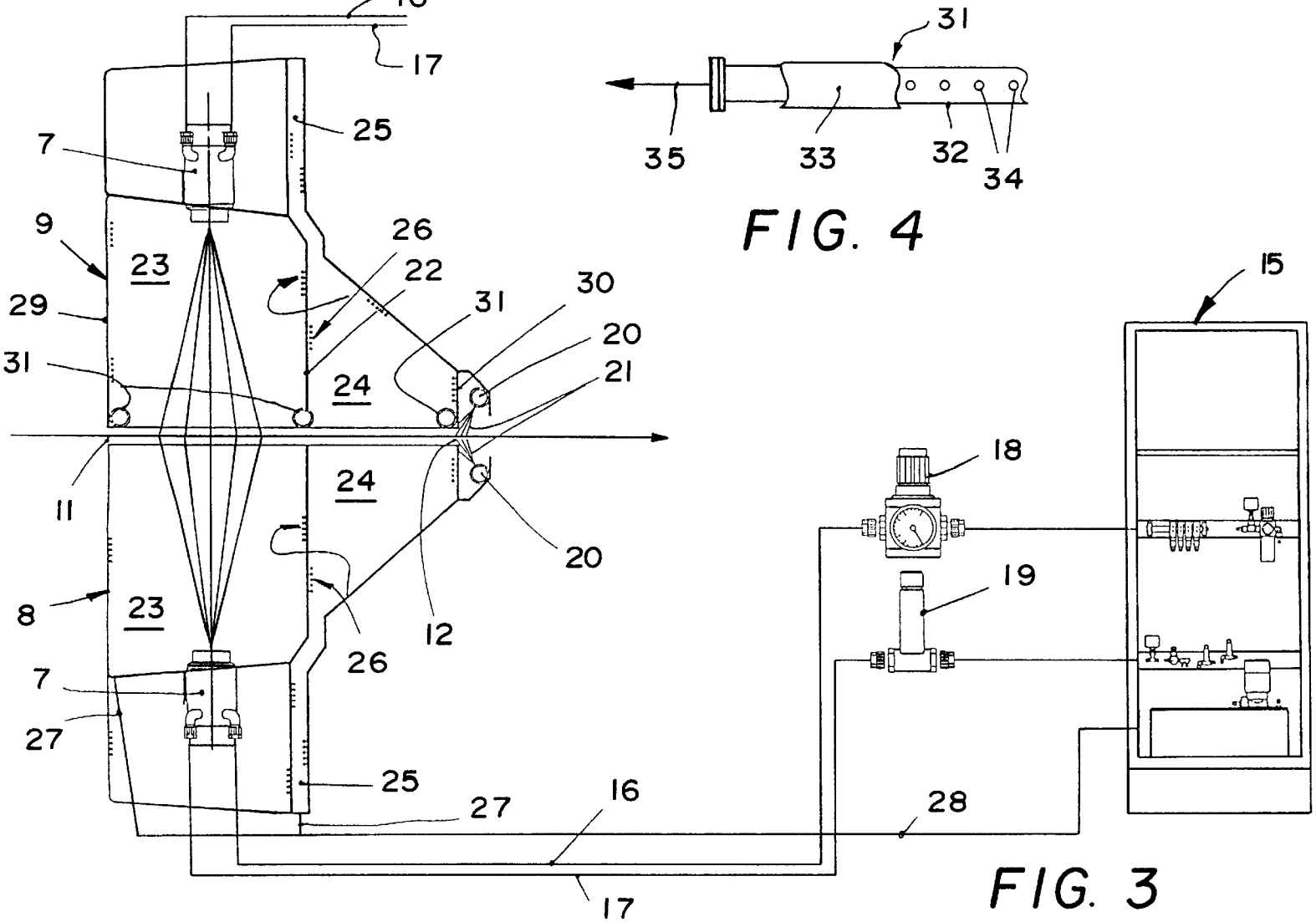
FIG. 3 is a section through the remoistening device in accordance with the present invention.
FIG. 4 is a partial view of a drip-catcher tube of the remoistening device in accordance with the present invention.

The nozzles 7 provided in the lower housing part 8 and the upper housing part 9, which can be arranged in the form of a row, oriented transversely with respect to the direction of running of the web of printed material 1, and distributed evenly over the width, are supplied from a supply station 15, as shown in FIG. 3. The supply station 15 can be integrated into the remoistening device. The example shown is based on a supply station located nearby, which is connected by lines with the respective consumers. In the example shown, the nozzles 7 are embodied as two-component nozzles, which are charged with liquid, which as a rule can be simple tap water, and air. Accordingly, two supply lines 16, 17 for liquid and air are associated with each nozzle 7. The mixture ratio between liquid and air is adjustable. To this end, appropriate metering valves 18, 19 are arranged in the supply lines. This allows the adaptation of the mixing ratio of liquid and air to the respective paper quality.

The use of two-component nozzles assures that small liquid droplets are created, which are not only evenly distributed over the width of the web of printed material 1, but are also charged with high energy and therefore have a great penetrating force and so get dependably on the web of printed material 1. In this connection it must be assumed that the web of printed material 1 moving at high speed carries along layers of air resting against its top and bottom, through which the liquid droplets must penetrate in order to assure a dependable remoistening of the web of printed material 1.

The spray nozzles 7 generate an aerosol-like fog spray. Steam is generated at the same time. The web of printed material 1 leaving the dryer 2 has a comparatively high temperature of often more than 100° C., so that a large amount of the liquid impinging on the web of printed material 1 evaporates. In order to prevent fog and/or steam from being taken out of the housing formed by the lower housing part 8 and the upper housing part 9 by the moving web of printed material 1 or the air layers carried along by it, air squeegee devices 20, which are situated opposite each other with respect to the conveyance plane of the web of printed material 1, are provided at the outlet slot 12. These generate an air jet 21 over the entire width of the outlet slot 12, which blows obliquely from above and below into the outlet slot 12 counter to the direction of movement of the web of printed material 1 and in this way assures that the web of printed material 1 cannot take anything along into the exterior. In an advantageous manner the air squeegee devices 20 operate contactless and at the same time assure that the outlet slot 12 can have a comparatively large clear width, so that even in case of fluttering the web of printed material 1 does not make contact with the slot edges.

Air squeegee devices of the above mentioned type can also be provided in the area of the inlet slot 11. However, as a rule this is not necessary because the air layer taken along by the web of printed material already see to it that no liquid can get to the outside through the inlet slot 11. It would also be conceivable to provide such air squeegee devices in the area of slot passages of interior transverse walls. However, in the normal case it is sufficient if, as in the represented example, air squeegee devices are only associated with the outlet slot 12.

The air squeegee devices 20 consist respectively of a tube extending over the entire slot width or the width of the remoistening device 6, which is arranged obliquely above and obliquely below the outside of the outlet slot 12 and is provided with nozzle bores, whose axis is tilted forward in the running direction with respect to a perpendicular line on the web of printed material plane, so that jets 21 directed obliquely into the outlet slot 12 result.

In order to relieve the air squeegee devices 20, the lower housing part 8 and the upper housing part 9 are each divided into two chambers by an interior transverse wall 22, as further shown in FIG. 3, namely a spray chamber 23 at the inlet side, which receives the spray nozzles 7, and a nozzle-free condensation chamber 24 placed downstream of it. By means of the separating wall 22 directly charging the air squeegee devices 20 by the spray jets and liquid spatters, etc., created by the spray nozzles 7, is prevented. The nozzle-free condensation chambers 24 at the same time provide a comparatively long evaporation path placed upstream of the outlet slot 12, in which excess liquid not absorbed by the web of printed material 1 can evaporate, by means of which heat is removed in a desired manner from the web of printed material 1, which can relieve the downstream located cooling device 3. Exhaust air chimneys branching off upward and downward from the condensation chambers 24 are provided to prevent the formation of overpressure in the housing interior.

Spraying is performed in the spray chamber 23. Therefore fog and liquid spatters also are deposited on the walls of the spray chamber 23 besides steam, which can lead to the droplets indicated at 26. Condensation of steam takes place in the condensation chambers 24. The steam evaporating from the printed web 1 in the condensation chambers 24 is deposited on the comparatively cold chamber walls, so that collections can form, which are also indicated by droplets 26 in FIG. 3. This also applies to the exhaust air chimneys 25. These are suitably extended past the spray chambers 23, so that comparatively cold zones result, in which condensation is encouraged and the air is dried by this prior to exiting into the surroundings.

The walls near the ceiling of the upper spray chamber 23 and the condensation chamber 24 are obliquely inclined so that the droplets forming on them can run off without dripping. The lower housing part 8 is embodied mirror-reversed with respect to the upper housing part 9, so that correspondingly inclined bottom surfaces result here. In its lowest area the lower spray chamber 23 is provided with an outlet 27 on the bottom, which is connected with a drain line 28 which leads back to the supply station 15. By means of this, the liquid running down the walls of the lower spray chamber 23 is returned to the supply station 15. The lower exhaust air chimney 25 is provided in the same way with a liquid outlet 27, which is connected with the drain line 28, so that the liquid running down the walls of the lower condensation chamber 24 and the lower exhaust air chimney 25 is also returned to the supply station 15.

The precipitation on the walls of the upper housing part 9 extending in the running direction of the web of printed material 1 can simply run down past the respective sealing strip and in this way can be removed via the respective liquid outlet 27, since the housing is wider than the web of printed material 1. The precipitation on the walls of the upper housing part 9 extending crosswise to the running direction of the web of printed material 1 is caught at the respective lower wall edge in order to prevent it from dripping on the web of printed material 1, and thus its soiling and possibly softening.

To this end drip catchers 31 are disposed on the lower ends of the wall of the upper housing part 9 extending crosswise to the running direction of the web of printed material 1, i.e. in this case on the separating wall 22 between the spray chamber 23 and the condensation chamber 24 and on the front or rear front wall 29, 30, which are parallel with it, of the spray chamber 23 or condensation chamber 24, which receive the drops running down the respectively associated wall and move them away. The drip catchers 31 can be embodied as channels extending around the lower edge of the respectively associated wall. In the example represented, the drip catchers 31 are embodied in a tube shape and attached to the respectively associated wall in such a way that a small channel results between the wall and the tube circumference.

In the example represented, the drip catchers 31 consist of an inner tube 32, on which a hose 33 of a textile material has been pulled, which can be best seen in FIG. 4. The tube 32 is provided with one or several rows 34 of holes which are arranged in such a way that the tube 32 is closed toward the bottom. An upper hole row 34 is provided in the example represented. The hose 33 is suitably made of a tight-meshed textile material, such as velvet. This assures good absorbency. The liquid collected on the circumference of the drip catchers 31 embodied in this way is guided to the holes of the row 34 of holes because of this absorbency, through which the liquid gets into the tube 32 and can be removed through this.

To aid this process, it is possible to charge the tubes of the drip catcher 31 with an induced suction draft, as indicated by an arrow 35 in FIG. 4. To this end the tubes 32 are closed on one end and connected at the other end with the suction connector of a pump. A liquid separator can be provided in the area upstream or downstream of the pump, whose outlet can terminate in the drain line 28, so that the liquid captured by means of the drip catchers 31 can also be returned to the supply station 15.

What is claimed is:

1. A remoistening device for remoistening a freshly printed and dried web of printed material, comprising:

a dryer;

a cooling device;

a housing through which the web of printed material runs defining thereby a conveyance plane, said housing being situated between said dryer and said cooling device, said housing including an upper housing area and a lower housing area, said upper and lower housing areas defining an inlet slot and an outlet slot through which the web of printed material pass;

a plurality of spray nozzles arranged above and beneath said conveyance plane, said nozzles being supplied with a moistening agent;

drip catchers arranged at the lower edges of the walls of said upper housing area, and which cross said conveyance plane; and air squeegee devices provided at least in the area of said outlet slot, said air squeegee devices being charged with compressed air and being situated across from each other with respect to said conveyance plane.

2. The remoistening device as defined in claim 1, wherein said drip catchers comprise a tube closed toward its bottom, and a hose of textile material for covering said tube.

3. The remoistening device as defined in claim 2, wherein said tube is provided with at least one upper row of holes.

4. The remoistening device as defined in claim 1, wherein said drip catchers are charged with an induced suction draft.

5. The remoistening device as defined in claim 2, wherein said hose is made of a tight-meshed textile material, such as velvet.

6. The remoistening device as defined in claim 1, further comprising:

sealing means for sealing said upper housing area from said lower housing area in said running direction of the web of printed material, said housing areas comprising housing elements which can be removed from each other.

7. The remoistening device as defined in claim 6, further comprising:

a lifting device for lifting said upper housing area from said lower housing area.

8. The remoistening device as defined in claim 1, wherein said housing further including a spray chamber containing said plurality of spray nozzles, said spray chamber extending coincident with said upper housing area and said lower housing area, and a nozzle-free condensation chamber placed downstream of said spray chamber in the running direction of the web of printed material.

9. The remoistening device as defined in claim 8, further comprising:

a drain line, wherein said condensation chamber has an exhaust air chimney, which with said spray chamber define a liquid outlet connected with said drain line.

10. The remoistening device as defined in claim 1, wherein said upper housing area and said lower housing area each define a surface that is inclined with respect to said conveyance plane.

11. The remoistening device as defined in claim 1 further comprising:

a holding device, wherein said cooling device includes support means, and wherein said housing is supported on said support means by said holding device.

12. The remoistening device as defined in claim 11, further comprising:

a lifting device for lifting said upper housing area from said lower housing area, wherein said holding device has a bracket connected with the lower housing area on which said lifting device is disposed.

13. The remoistening device as defined in claim 1, wherein said plurality of spray nozzles are charged with a liquid, such as water and air.

14. The remoistening device as defined in claim 1, wherein the mixing ratio of the media supplied to said plurality of nozzles is adjustable.

15. The remoistening device as defined in claim 1, wherein said air squeegee devices having at least one tube which is charged with compressed air, said tube being provided with a blowing nozzle with a blow direction component directed opposite to said conveying direction.

* * * * *